United States Patent [19]

Brock

[11] 4,314,395

[45] Feb. 9, 1982

[54] SURFACE ROLLER

[76] Inventor: William L. Brock, 6480 W. 60th Ave., Arvada, Colo. 80003

[21] Appl. No.: 89,814

[22] Filed: Oct. 31, 1979

[51] Int. Cl.[3] ..... B21B 27/00

[52] U.S. Cl. ..... 29/110.5; 15/230.11; 156/579; 29/125

[58] Field of Search ..... 29/110.5, 116 R, 124, 29/125; 156/579, 574; 15/230.11

[56] References Cited

U.S. PATENT DOCUMENTS

| | | | |
|---|---|---|---|
| 157,387 | 12/1874 | Frazier | 29/110.5 |
| 563,044 | 6/1896 | Lewis | 29/110.5 |
| 3,115,659 | 12/1963 | Church | 15/230.11 |
| 3,127,299 | 3/1964 | Hecht | 156/579 |
| 3,641,643 | 2/1972 | Niemi | 29/110.5 |
| 4,198,723 | 4/1980 | Hiller et al. | 15/230.11 |

*Primary Examiner*—Peter P. Nerbun

*Attorney, Agent, or Firm*—O'Rourke & Harris

[57] ABSTRACT

A device for applying pressure to a surface. A base member has a contacting means mounted on its lower face and a pressure conveying means mounted on its upper face. The user applies pressure to the device through handles. The pressure is conveyed through the handles, carrier members, and axles to rollers. The device is lightweight and portable such that it may be used on walls, ceilings, and in confined spaces as well as for conventional floor installation.

9 Claims, 3 Drawing Figures

SURFACE ROLLER

This invention relates to the field of surface rollers. More particularly, this invention relates to a device for applying pressure to a surface. In still greater particularity, this invention relates to a device for applying pressure to a newly installed surface in order to attach that surface to its underlying support. By way of further characterization, but not by way of limitation thereto, the invention relates to a lightweight, hand-held, portable device for rolling a newly installed surface.

DESCRIPTION OF THE PRIOR ART

A newly installed surface requires that pressure be applied after installation in order that it may be firmly secured to the underlying structure. For example, floor coverings such as tile or vinyl floor covering are secured to the underlying floor by a mastic or glue type substance. Once installed, these floor coverings require that pressure be applied thereto in order to eliminate any air pockets between the floor covering and the underlying floor. This insures a good bond between the floor covering, the adhesive and the underlying floor.

Devices presently in use include large, heavy rollers weighing up to 120 pounds or more. These rollers are cumbersome and heavy, often requiring more than one person to carry the device to the installation site. Transporting the roller is especially difficult when stairs or other obstacles are encountered. Because of their weight conventional rollers are not useful for surfaces other than floors. That is, they are not generally used on walls or ceilings. In addition, because of their size these devices will not lend themselves to operation in small or confined spaces. Therefore, in the case of floor coverings, the portion of the floor covering which extends under areas such as toe kicks along cabinets is not rolled.

The size and weight of conventional rollers also require that they be stored away from newly installed surfaces. That is, the roller may not be left on a newly installed surface because it may leave a crease in the surface due to its heavy weight. Because the device must be stored away from the newly installed surface, the installer is generally required to stand up and go to the roller and bring it to the newly installed area. This requires extra time and effort by the installer and thus reduces his efficiency.

SUMMARY OF THE INVENTION

The invention is a device for applying pressure to a newly installed surface. The device includes a base member, a means for contacting the newly installed surface, and a means for conveying pressure to said surface. The base member is a substantially rectangular, lightweight sheet having an upper face and a lower face. Handles are attached to the upper face and a plurality of rollers are mounted on the lower face. A resilient coating on the outside of the rollers prevents scratching or marring of the surface to be rolled. The corners on the base member sheet are rounded to also prevent nicks or scratches to surrounding surfaces.

DESCRIPTION OF THE PREFERRED EMBODIMENT

Figure 1:
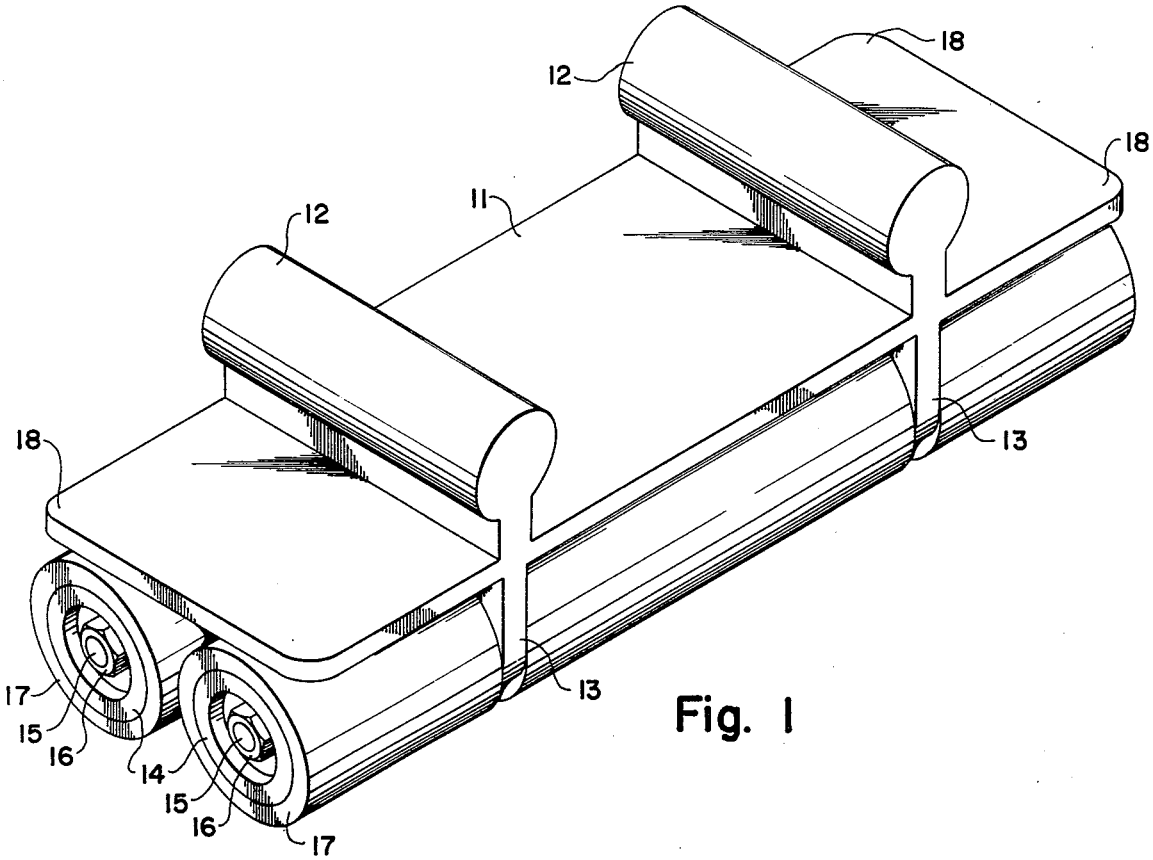
FIG. 1 is a perspective view of the invention.

Referring now to the drawings wherein like reference numerals denote like structure throughout each of the various drawings, FIG. 1 is a perspective view of the invention. A base member 11, which may include a substantially rectangular sheet of lightweight material such as aluminum, has attached thereto a pair of handles 12. A pair of carriers 13 are mounted on the lower face of sheet 11 substantially opposite to handles 12. A plurality of rollers 14 are rotatably mounted on carriers 13. That is, axles 15 extend the length of the long side of base member 11 through carriers 13. Rollers 14 are secured on axles 15 by conventional means such as by nuts 16. A layer of resilient material 17 is mounted on the outside of rollers 14. In the preferred embodiment shown base member 11 is a substantially rectangular sheet having four rounded corners 18.

Figure 2:
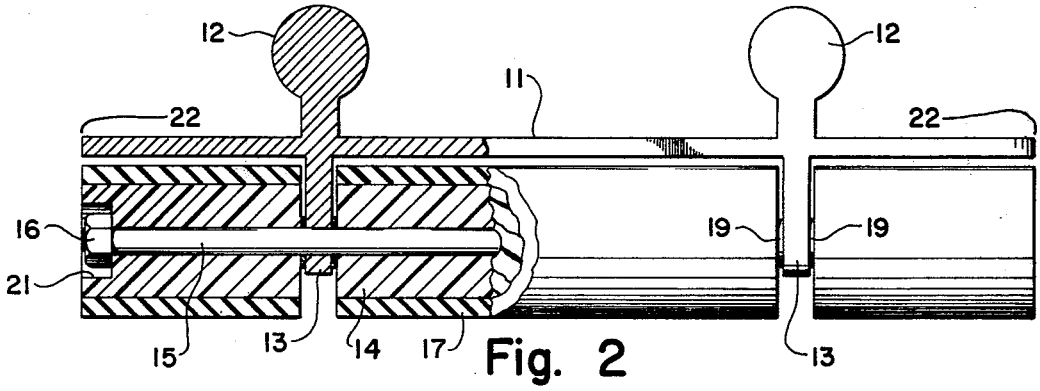
FIG. 2 is a partially sectioned front view of the invention.

Referring to FIG. 2, a partially sectioned front view of the roller construction is shown. Base member 11 has handles 12 attached to its upper face a predetermined distance from the short sides 22 of base member. Predetermined distance is sufficient to allow the device to extend into recessed areas such as cabinet toe kicks or the like. Carriers 13 are attached on the lower face of base member 11 substantially opposite to handles 12. Rollers 14 are mounted on axle 15. A layer of resilient material 17 is mounted on the outside of rollers 14. A plurality of spacers 19 are mounted on axles 15 and disposed between carriers 13 and rollers 14. The outside rollers are mounted on axle 15 by conventional means such as nut 16. Nut 16 is mounted on axle 15 in a recess 21.

Figure 3:
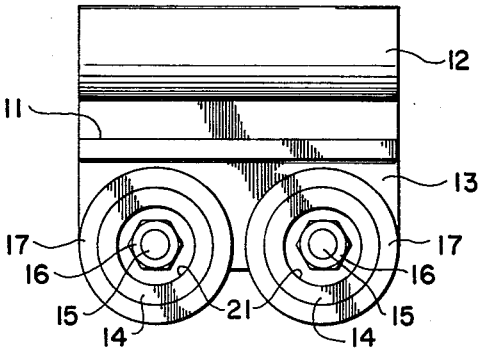
FIG. 3 is a side view of the invention.

Referring to FIG. 3, a side view of the invention is shown. Base member 11 has handles 12 mounted on its upper face. Carrier 13 is mounted on the lower face of base member 11. Rollers 14 are mounted on axles 15. The outside rollers are secured on axles 15 by nuts 16. Nut 16 is mounted in a recess 21 in rollers 14. A layer of resilient material 17 is mounted on the outside of rollers 14.

MODE OF OPERATION

After the new surface has been installed, the present invention may be utilized to secure the new surface to the mastic or other adhesive. That is, the installer of the new surface may pick up the relatively lightweight invention and, by gripping handles 12 and exerting force on the device, apply pressure to the newly installed surface thereby rolling out any air pockets which may remain. The new surface is thus tightly secured to the mastic or other adhesive. By applying force at handles 12, the installer applies force to the rollers 14 which contact the new surface. The force applied by the installer is conveyed through handles 12 and carriers 13 to a contacting means which may include axles 15, rollers 14 and resilient layer 17. The layer of resilient material 17 on the outside of rollers 14 assures that the new surface will not be marred by rollers 14.

Handles 12 are spaced a predetermined distance from the short sides 22 of base member 11 in order that the device may be used to roll a surface under a cabinet toe kick or similar structure. Rounded corners 18 help to prevent marring of surrounding structure.

Because of its lightweight and compact size, the invention may be utilized by the installer while still in the crouched position. This eliminates the necessity for the installer to stand up and retrieve a conventional type roller. Thus the time for installing the surface and rolling out any air pockets is reduced. Because of its light weight the roller can be placed on newly installed surfaces without leaving a crease or other mark on that surface. Its compact size also allows the invention to be maneuvered around in small room areas with great ease. The roller may also be rolled up close to the edges of newly installed surfaces adjacent walls and other equivalent obstacles.

Referring to FIG. 2, recess 21 allows nut 16 or other conventional attaching mechanisms to secure rollers 14 on the outside of axles 15 without protruding beyond the edge of the device. Therefore, when newly installed surfaces are rolled, surrounding structures such as walls, toe kicks, or other similar type structures are not scratched or marred by the protruding attachment mechanism. Spacers 19 between roller 14 and carriers 13 prevent the side to side movement of rollers 14 thereby making the device easier to use and preventing binding of rollers 14 and resilient layer 17 against carriers 13.

Resilient layer 17 may be rubber or other suitable substances which will not mar or damage newly installed surfaces. Resilient layer 17 is conventionally attached to rollers 14 by glue or other conventional means. Rollers 14 may be plastic or any other suitable material. Handles 12 are made of wood or other suitable materials which allow for easy gripping of the device without damaging the installers hands. Aluminum or other relatively lightweight material may be utilized as base member 11.

Because of its light weight and relatively small size the surface roller may be used on other than newly installed floor surfaces. That is, while the device may advantageously be used to replace a conventional roller for floor tiles and rubber or foam backed carpet, the device is also useful to roll other surfaces on areas such as walls or ceilings. For example, the device may be used on wallcoverings such as panelling which is installed with mastic or other adhesive. The device may also be used to install laminated counter top material. The device may also be advantageously used on surfaces which are not flat such as on rounded corners.

While particular forms of the invention have been described with respect to a particular embodiment thereof, it is not to be so limited as changes and modifications may be made therein which are within the full intended scope of the invention as defined by the appended claims.

The foregoing description, taken together with the appended claims, constitutes a disclosure which enables one skilled in the art and having the benefit of the teachings contained therein to make and use the invention. Further, the structure herein described constitutes a meritorious advance in the art which is unobvious to such skilled workers not having the benefit of these teachings.

What is claimed is:

1. A device for applying pressure to a surface, the device comprising:

a substantially planar elongated base member having an upper face and a lower face;

a pair of carrier supports each positioned inwardly from an end of the base member at the elongated portion thereof, the carrier supports extending perpendicular from the lower face of the base member;

at least two roller assemblies rotatably carried on the carrier supports, each assembly being journaled around an axis extending in the elongated direction of the base member and parallel to the other axis, and each roller assembly extending between the carrier supports and beyond the carrier supports with the ends of each roller assembly extending at least to the ends of the base member in a cantilevered manner; and a pair of handle members extending from the upper face of the base member, with each of the handle members being aligned with a support carrier;

whereby the rollers define a plane providing a firm support for the device and extend at least to the edge of the base member to facilitate application of pressure in close quarters and corners, while the handle members transmit force directly to the carrier support and roller assemblies to permit the development of great pressures at the roller assemblies.

2. A device as set forth in claim 1 in which each roller assembly comprises a pair of outboard independent roller segments extending from each carrier support to at least the end of the base member, and at least one central roller segment extending between the carrier supports, all of the roller segments of a single assembly being aligned on a single axis.

3. A device as set forth in claim 1 in which the surfaces of the roller assemblies include a resilient material layer positioned thereon.

4. A device as set forth in claim 1 in which the base member comprises a substantially rectangular lightweight plate.

5. A device as set forth in claim 4 wherein said lightweight plate includes substantially rounded corners.

6. A device as set forth in claim 1 in which two roller assemblies are provided, the axis of each being equally spaced from the lower face of the base member.

7. A device for applying substantial pressures to a surface, the device comprising:

a substantially rectilinear plate having an upper face and a lower face;

a pair of carrier supports each positioned inboard from the opposed ends of the plate member and extending perpendicular from the lower face of the plate member;

two roller assemblies rotatably carried relative to the carrier supports, each roller assembly being journaled around an axis with each axis being spaced an equal amount from the lower face of the plate member and parallel to the other axis, and each roller assembly including a pair of outboard roller segments each extending without additional support from one of the carrier supports to at least the end of the plate member, and a central segment extending between the carrier supports; and a pair of handle members extending from the upper face of base member, each of the handle members being structurally aligned with a carrier support and adapted to transmit force directly from the handle member through the intervening plate member to the aligned support carrier;

whereby a lightweight roller device may be provided to afford a support base formed of the two roller assemblies, to transmit substantial forces directly from the handle members to the roller assemblies to minimize weight while permitting substantial pressures to be developed at the roller assembly, and to permit the application of pressure in confined areas, i.e., at right angled intersections.

8. A device for applying pressure as set forth in claim 7 in which the roller assemblies are covered at the outer surface thereof with a resilient material layer.

9. A device for applying pressure as set forth in claim 7 in which the rectilinear plate is a lightweight sheet.

* * * * *